US005826678A

United States Patent [19]

Yu

[11] Patent Number: 5,826,678

[45] Date of Patent: Oct. 27, 1998

[54] FIRE ESCAPE PARACHUTE

[76] Inventor: Yu-Li Yu, No. 223, Hou-Chu-Wei St., Sanchung, Taipei Hsien, Taiwan

[21] Appl. No.: 852,953

[22] Filed: May 8, 1997

[51] Int. Cl.[6] ..... A62B 5/00

[52] U.S. Cl. ..... 182/3; 135/16; 135/23; 135/31

[58] Field of Search ..... 135/16, 29, 31, 135/23, 28, 25.4; 182/3

[56] References Cited

U.S. PATENT DOCUMENTS

| | | | |
|---|---|---|---|
| 66,632 | 7/1867 | Robbins | 135/31 |
| 181,072 | 8/1876 | Hayward | 135/23 |
| 221,855 | 11/1879 | Oppenheimer . | |
| 539,762 | 5/1895 | Barnett | 135/31 |
| 5,353,977 | 10/1994 | Schiro | 135/16 |

FOREIGN PATENT DOCUMENTS

| | | | |
|---|---|---|---|
| 62279 | 12/1925 | Switzerland | 135/16 |
| 931810 | 7/1963 | United Kingdom | 135/28 |
| WO 092018030 | 10/1992 | WIPO | 135/16 |

*Primary Examiner*—Alvin C. Chin-Shue
*Attorney, Agent, or Firm*—Rosenberg, Klein & Bilker

[57] ABSTRACT

A fire escape parachute is provided and includes a center shaft, top ribs, stretcher ribs, a main runner, reinforcing ribs, an upper runner, a fabric and a safety belt. The function of the runner is to drive the stretcher ribs which in turn push the top ribs to open the fabric. The reinforcing ribs will tightly pull the outer ends of the top ribs, so that the top ribs are bent downwards to form an arc and such is secured by reinforcing ropes to effectively prevent reverse upward turning of the fabric and the top ribs. Thus, in case of fire in a high-rise building, the fabric can be controlled and opened directly by the escapee, who will use the fire escape parachute to slowly descend from the high-rise building.

1 Claim, 7 Drawing Sheets

FIRE ESCAPE PARACHUTE

DESCRIPTION OF INVENTION

The present invention relates to a type of fire escape parachute, particularly to one with the mechanism to provide a safe escape with the equipment of a fire escape parachute mechanism by slowly descending from a high-rise building in case of fire.

Conventional fire escape stairs or slow-descending equipment may be used to help people escape safely from a hazardous place in case of fire or emergency. There are, however, some problems existing in those conventional methods. Such as, storage of the equipment that may severely affect the appearance of a building, occupation of much space, inconvenience in handling process, complicated operational procedures, inconvenience in actual application, sophisticated construction, high production costs, etc. The result is lack of extensive promotion due to those difficulties that could not effectively reduce the casualties caused by high-rise fire accidents.

In actual applications, conventional fire escape stairs or slow-descending equipment do involve aforesaid inconveniences and disadvantages that need to be improved.

In view of the above, therefore, the subject inventor has invested some time and efforts in the intensive research, with theoretical applications, of the subject invention based on reasonable designing for effective improvement of said disadvantages.

The main purpose of the subject invention is to provide a type of fire escape parachute that enables the escapee to descend from a high-rise building to safe ground, in case of fire, by directly controlling the parachute, with such features of easy operation in actual use, dual purpose for simultaneous use as an ordinary umbrella, reduced space when not in use, convenient portability and storage, great convenience in use, will not affect a building's appearance, low production cost, and such features that enable extensive promotion for effectively reducing the casualties caused by high-rise fire accidents.

To achieve the aforesaid purposes and construction, the designs and functions of the subject invention are described in the following drawings:

DESCRIPTION OF DRAWING:

| | |
|---|---|
| 10 center shaft | 11 top rib |
| 12 stretcher rib | 13 main runner |
| 14 reinforcing rib | 15 upper runner |

-continued

| | |
|---|---|
| 16 fabric | 17 safety belt |
| 18 hand grip | 19 ferrule |
| 20 inside cap | 21 joint |
| 22 joint | 23 fixing device |
| 24 pivot | 25 push button |
| 26 catch piece | 27 spring |
| 28 positioning hole | 29 bolt |
| 30 fixing ring | 31 fixing hole |
| 32 buckle | 33 reinforcing rope |
| 34 buckle | 35 buckle |

Figure 1:
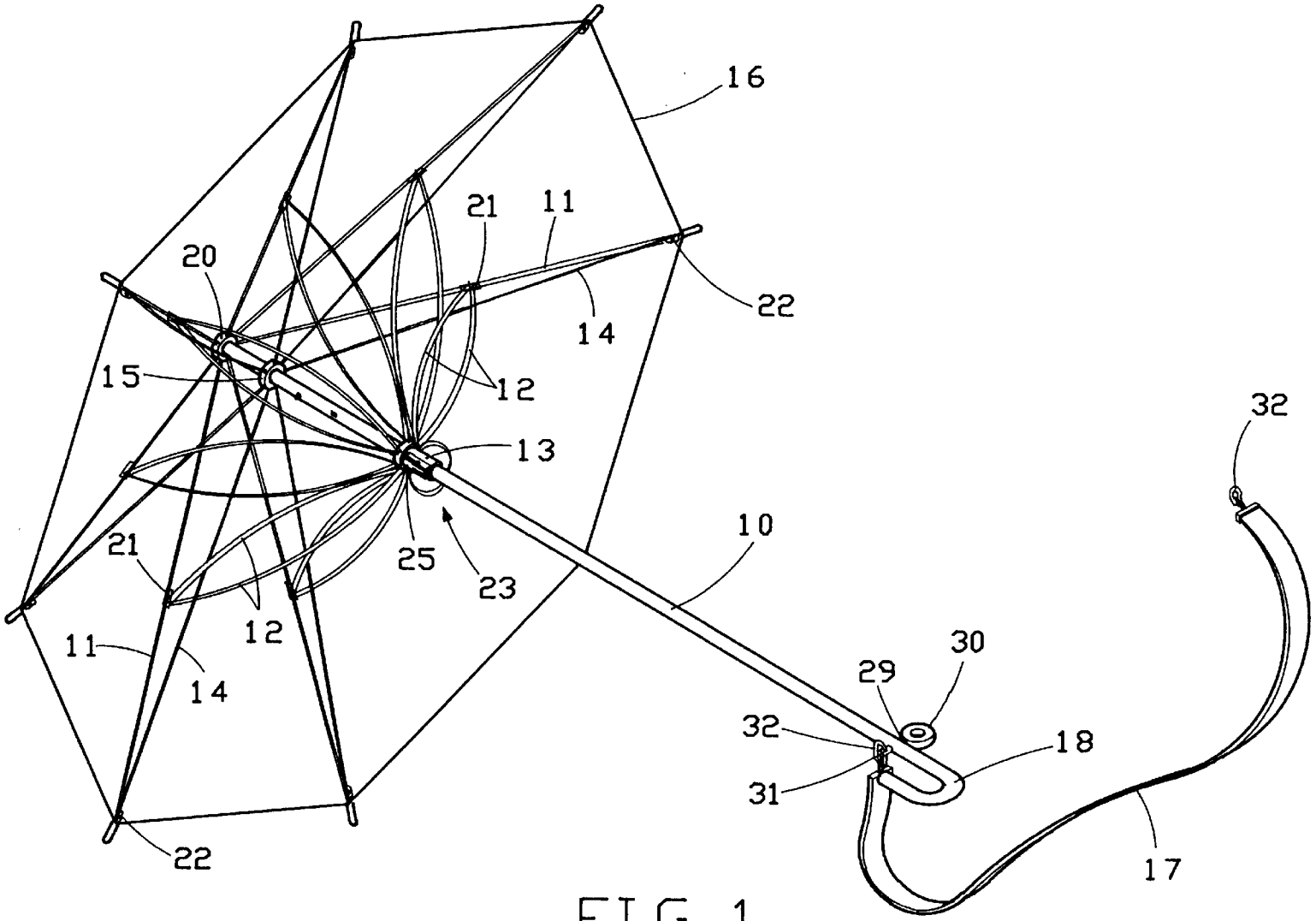
FIG. 1 is the perspective view of the subject invention.
Figure 2:
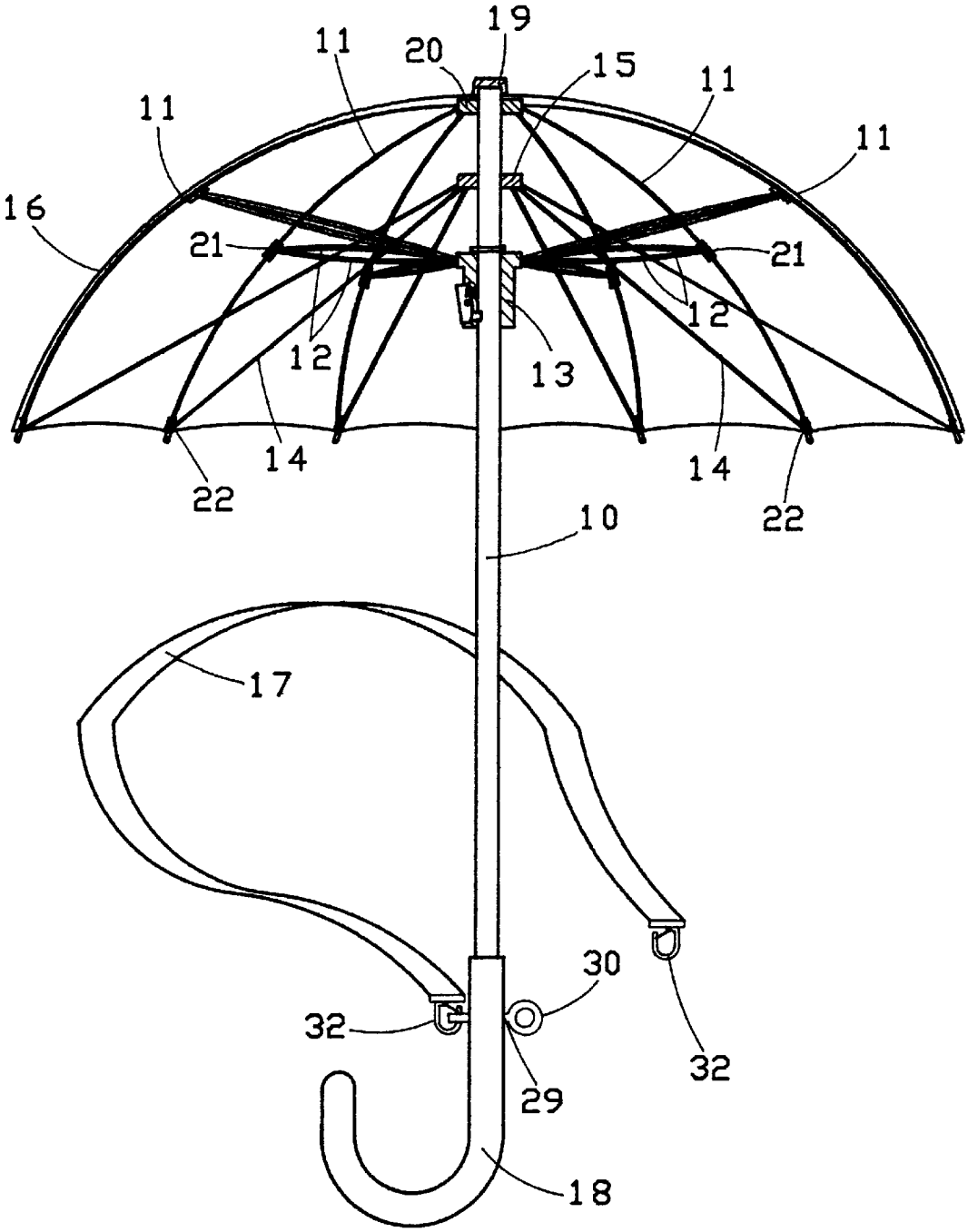
FIG. 2 is the front view of the subject invention.

Referring to FIG. 1 and 2 which are respectively the perspective view and front view of the subject invention that provides a type of fire escape parachute comprising of a center shaft 10, several pieces of top ribs 11, several pieces of stretcher ribs 12, a main runner 13, several pieces of reinforcing ribs 14, an upper runner 15, a fabric 16 and a safety belt 17, wherein, the center shaft 10 is a holler round tube, to the bottom of said center shaft 10 is fixed a hand grip 18, to the top of said center shaft 10 is fixed a ferrule 19, below the ferrule 19 is fixed an inside cap 20. The main runner 13 and upper runner 15 are fixed onto the center shaft 10 below the inside cap 20, the main runner 13 is located below the upper runner 15.

Several pieces of top ribs 11 are respectively joined to the inside cap 20, said top ribs being in radial arrangement, the fabric 16 being made of water-repellent materials and fixed onto the top ribs 11 by properly combining the fabric 16 with the top ribs 11 to become an integrated unit. Each top rib 11 may be joined with two stretcher ribs 12, the inside ends of the two stretcher ribs 12 are joined to the main runner 13, said stretcher ribs being made of sheet steel or such materials of equivalent quality and in lotus arrangement to assure a better strength. When the main runner 13 moves up and down on the center shaft 10, it will drive the stretcher ribs 12 and top ribs 11 to perform stretching or folding functions, thus controlling the fabric 16 to stretch or collapse.

To each top rib 11 is fitted with a reinforcing rib 14, the outer end of each reinforcing rib 14 being joined to the outer end of the top rib 11 by a joint 22, the inner end of the reinforcing rib 14 being joined to the upper runner 15, each reinforcing rib 14 being penetrated between two stretcher ribs, and because of the shorter length of the reinforcing rib 14, it will tighten the outer end of the top rib 11, so that each top rib 11 is bent to form a downward arc.

Figure 3:
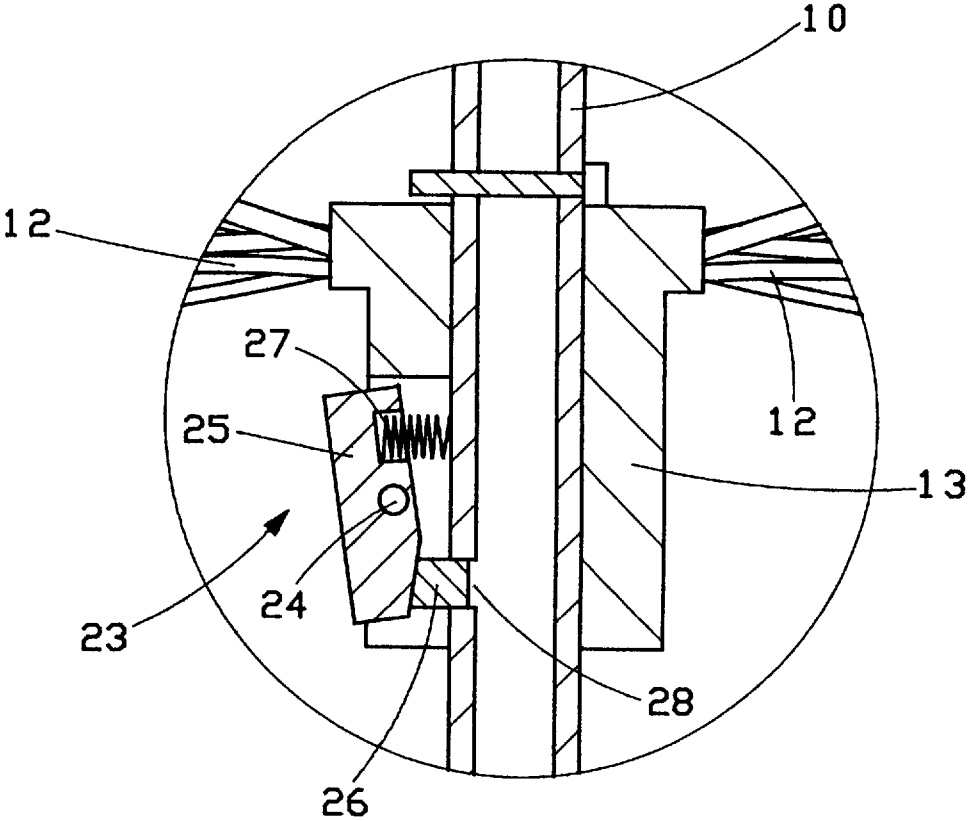
FIG. 3 is the detailed view of a part of the subject invention.

Referring to FIG. 3 which is a perspective view of a part of the subject invention, wherein, between the main runner 13 and the center shaft 10 is fitted an appropriate fixing device 23 which involves a push button 25 on a pivot 24 on the main runner 13, at one end inside the push button 25 is a catch piece 26, on the other end inside the push button 25 is a spring 27, the spring will push against the push button 25, so the catch piece 26 on the other end of the push button 25 can be located in the positioning hole 28 on the center shaft 10. When the main runner 13 moves upwards on the center shaft 10, so the stretcher ribs 12 push the top ribs 11 to stretch the fabric 16 to position, the catch piece 26 in the push button 25 will move to the positioning hole 28, so the catch piece 26 is positioned to the positioning hole 28 on the center shaft, so the main runner 13 can be positioned on the center shaft 10, so the fabric 16 is maintained in stretched status. To move the main runner 13, one has to push the push button 25 on the end where the spring 27 is pushing, so the catch piece 26 escapes the positioning hole 28 on the center shaft 10, and the main runner 13 will be able to move freely on the center shaft 10, so the main runner 13 moves downwards and the stretcher ribs 12 move the top ribs 11 to fold the fabric 16.

Figure 4:
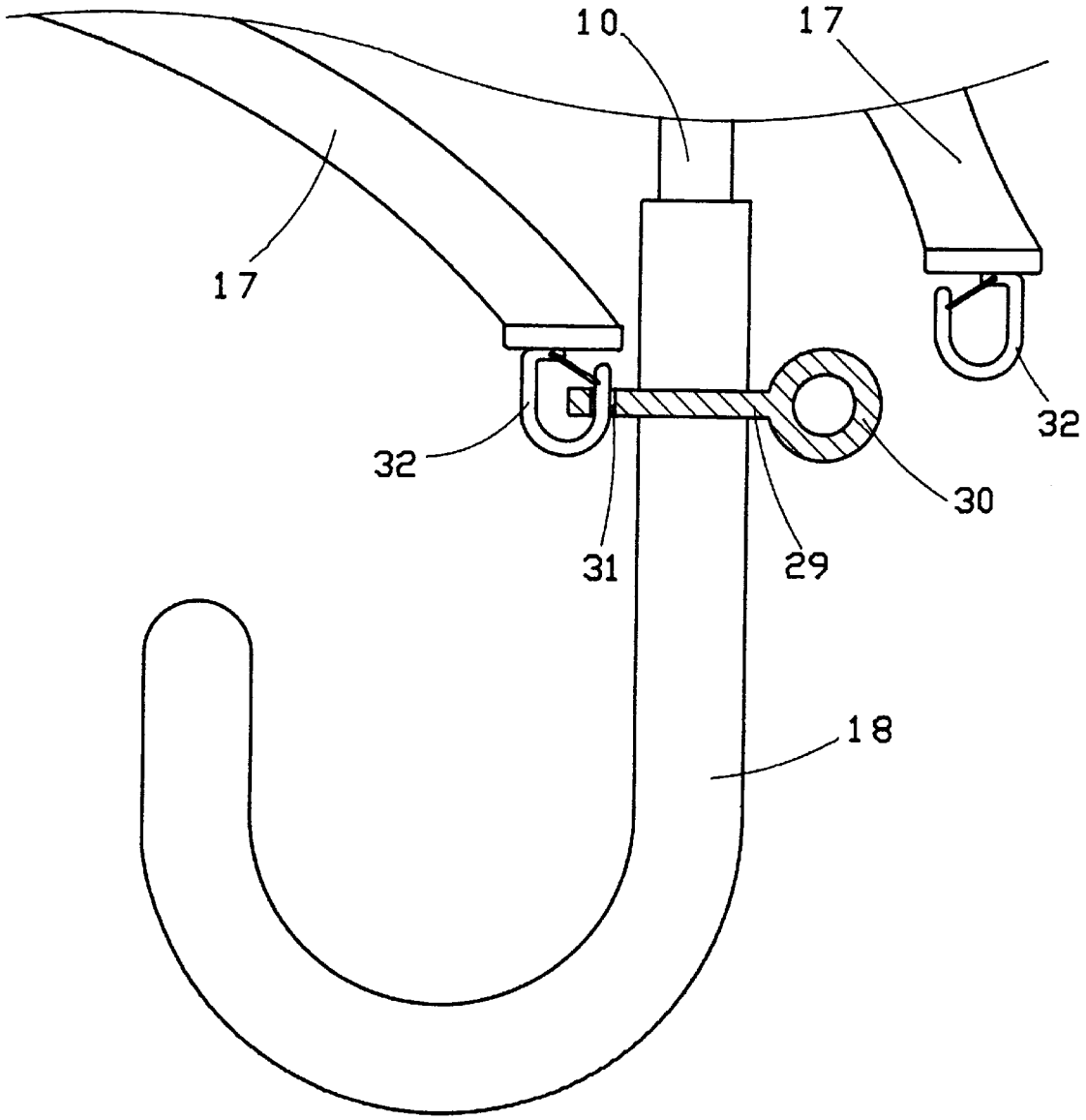
FIG. 4 is the detailed view of another part of the subject invention.

Referring to FIG. 4 which is a front view of a part of the subject invention, involving a bolt 29 fixed through the hand grip 18 on the lower end of the center shaft 10, on two ends of the bolt 29 are respectively a fixing ring 30 and a fixing hole 31, and to each end of the safety belt 17 is respectively fitted a buckle 32 which can be fastened onto the fixing ring 30 and fixing hole 31 on two ends of the bolt 29, so that the safety belt 17 can be joined to the hand grip 18 by the two buckles 32.

Figure 5:
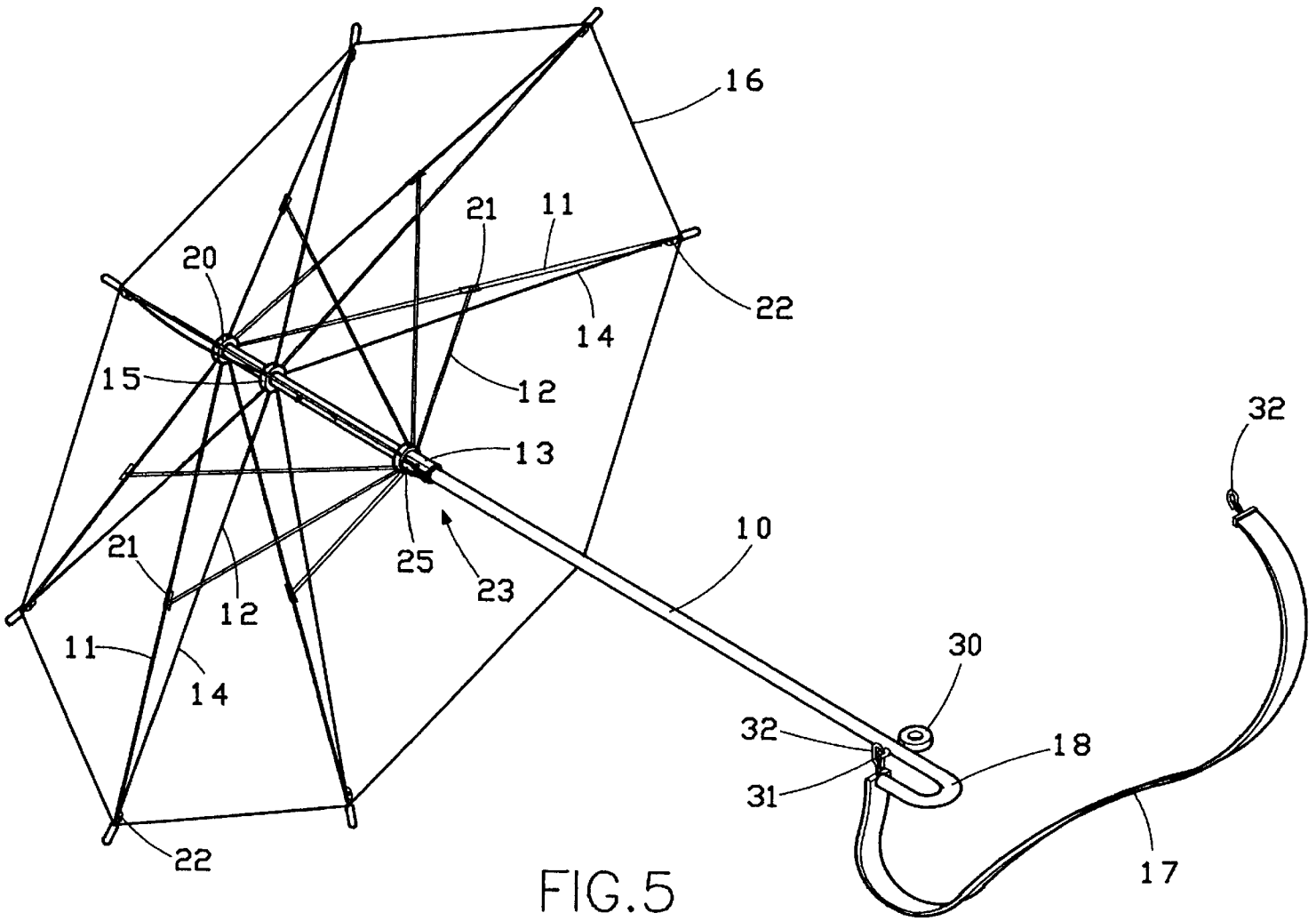
FIG. 5 is the perspective view of an embodiment of the subject invention.

Referring to FIG. 5 which is the perspective view of another embodiment of the subject invention, involving a stretcher rib 12 fitted to each top rib 11, the outer end of the stretcher rib 12 joined by a joint 21 to the middle of the top rib 11, the inner end of the stretcher rib 12 being joined to the main runner 13.

Figure 6:
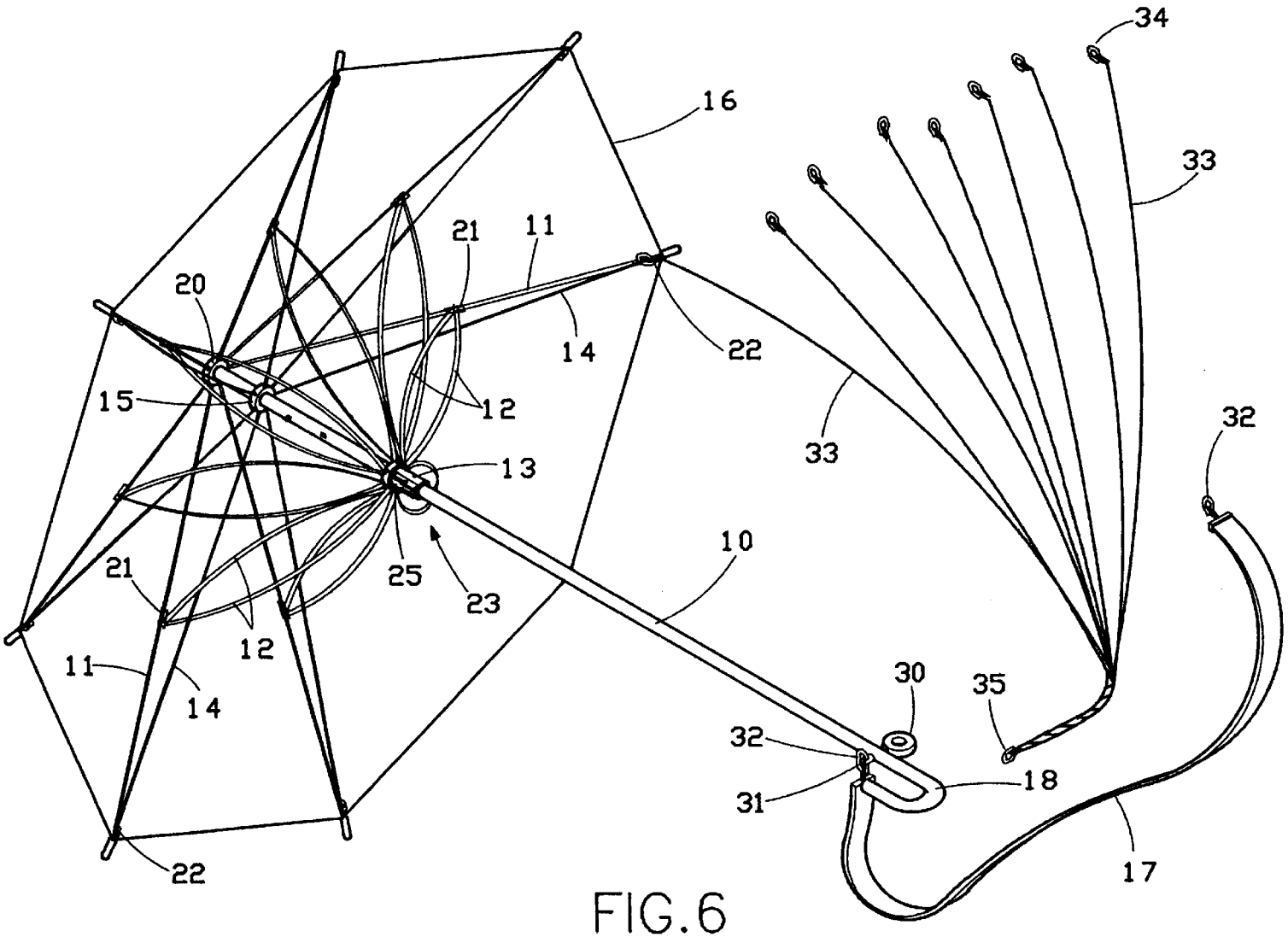
FIG. 6 is the perspective view of another embodiment of the subject invention.

Referring to FIG. 6 which is the perspective view of yet another embodiment of the subject invention. The subject invention could additionally include several pieces of reinforcing ropes 33 corresponding to the top ribs 11, a buckle 34 on the upper end of the reinforcing rope 33, the bottom ends of the reinforcing ropes 33 collectively joined to a buckle 35, the buckles 34 on the upper ends of the reinforcing ropes 33 can be fastened to between joining angle of the top ribs 11 with the reinforcing ribs 14, so that the upper ends of reinforcing ropes 33 connected to the top ribs 11, at the outer ends of reinforcing ribs 14, while the buckle 35 at the lower end of the reinforcing ropes 33 can be fastened to the fixing ring 30 (as in FIG. 7) on the hand grip 18, that the reinforcing ropes 33 will enhance the strength of the top ribs 11 and reinforcing ribs 14, said reinforcing ropes 33 can either be added or removed, because, if without the reinforcing ropes 33, the reinforcing ribs 14 have sufficient strength to perform the function to prevent the reverse upward bending of the fabric 16 and top ribs 11. In consideration of enhanced safety, the subject invention will require stricter requirements on the assembling and the strength of materials for such components as the center shaft 10, top ribs 11, stretcher ribs 12, main runner 13, reinforcing ribs 14, upper runner 15, fabric 16, safety belts, etc.

Figure 7:
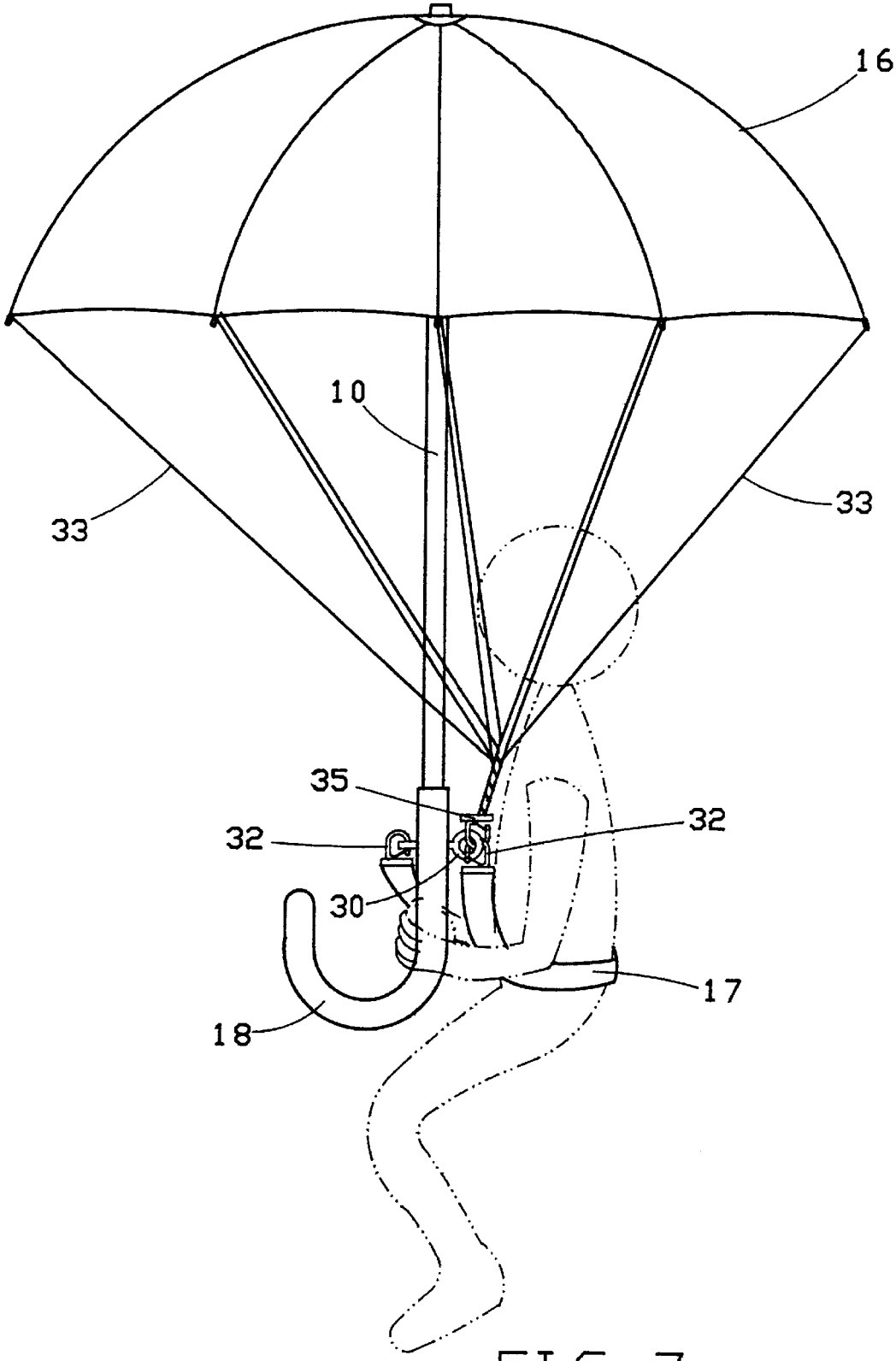
FIG. 7 is the view of the subject invention in actual application.

Referring to FIG. 7 which is the view of the subject invention in actual application in case of a fire in a high-rise building, the main runner 13 controls the fabric 16 to stretch open, with the fixing device 23 to secure the main runner 13, and the safety belt 17 can be fastened at an appropriate part of the escapee's body whose hands will hold onto the hand grip, the equipment of the safety belt 17 being to enhance better security in case the escapee should lose his grip on the center shaft when the safety belt will attach him to the parachute. With the subject invention, the escapee can directly control the opening of the fabric 16, so the escapee can jump from a high-rise building, just like a parachute, and slowly descend onto safe ground. Because of its easy operation, the escapee can use it easily, instead of jumping down empty-handed from a building and cause death or injury. Furthermore, the safety belt 17 and the reinforcing ropes can be removed from the subject invention, so it can also be used as an ordinary umbrella that will not occupy much space after it is folded for storage or to be brought to another place. It assures much convenience in actual use. When folded and stored, it will not affect the appearance of a building. Its simplified construction and low production costs will be favorable factors for extensive promotion to reduce casualties resulting from high-rise fire accidents.

Summing up, the subject invention involves the improvement of such disadvantages of conventional fire escape equipment as bad influence on the appearance of a building, occupation of much space, inconvenience in relocation, sophisticated operational procedures, complicated construction, high costs, etc. With such features of innovation and advancement, the subject invention will fully satisfy the requirements for a patent right. In accordance with the patent law, this application is filed for your favorable consideration and approval, to protect the rights and interests of the inventor.

The aforesaid description, involving the preferred embodiment of the subject invention, shall not be based to restrict or limit the scope of a patent for the subject invention. It is hereby declared that, all relevant structural variations based on the employment of the subject description and drawings shall be reasonably included in the patent of the subject invention.

I claim:

1. A fire escape parachute, comprising:

a parachute structure;

a handle;

a central shaft connecting to said parachute structure on an upper end thereof and said handle of an opposing end;

a bolt coupled to said handle having a fixing ring on one end thereof and a fixing hole formed through an opposing end of said bolt;

a safety belt, said safety belt having two ends, one of said two ends being buckled to said fixing ring and the other end of said safety belt being buckled to said fixing hole; and, a plurality of reinforcing ropes, each said reinforcing rope having a first end buckled to said fixing ring;

said parachute member including:

a main runner and an upper runner spaced from said main runner slidingly disposed on said central shaft;

a plurality of top ribs extending radially from said upper end of said central shaft, each of said top ribs having inner and outer ends, said inner ends of said top ribs being coupled to said upper end of said central shaft;

a plurality of reinforcing ribs, each said reinforcing rib being coupled between said upper runner and said outer end of a respective one of said top ribs;

a plurality of stretcher ribs, each of said stretcher ribs being coupled between said main runner and a respective one of said top ribs between said inner and outer ends thereof; and, a fabric enveloping said plurality of top ribs;

each of said reinforcing ropes having a second end buckled to said outer end of a respective one of said plurality of top ribs, thereby reinforcing said parachute member for withstanding reversing forces applied thereto.

* * * * *